US005321069A

United States Patent [19]

Owens

[11] Patent Number: 5,321,069

[45] Date of Patent: Jun. 14, 1994

[54] PROCESS FOR PRODUCING PHOSPHORESCENT YARN AND YARN PRODUCED BY THE PROCESS

[75] Inventor: Willard Owens, Chatsworth, Ga.

[73] Assignee: Afterglow Accent Yarns, Inc., Chatsworth, Ga.

[21] Appl. No.: 981,493

[22] Filed: Nov. 25, 1992

[51] Int. Cl.[5] ..... C08K 3/30; D02G 3/00

[52] U.S. Cl. ..... 524/420; 428/365

[58] Field of Search ..... 524/420; 428/365

[56] References Cited

U.S. PATENT DOCUMENTS

| | | | |
|---|---|---|---|
| 2,084,526 | 5/1936 | Grenier | 106/22 |
| 2,382,355 | 9/1942 | Warren | 252/301.36 |
| 2,457,808 | 3/1945 | Dort | 8/57 |
| 2,635,969 | 3/1950 | Goldstein | 252/301.36 |
| 2,787,558 | 4/1957 | Wadely | 117/33.5 |
| 3,193,536 | 7/1965 | Wagner et al. | 252/301.35 |
| 3,291,668 | 12/1966 | Goldstein | 252/301.36 |
| 4,546,042 | 10/1985 | Quon | 428/378 |
| 4,781,647 | 11/1988 | Doane, Jr. | 428/699 |

FOREIGN PATENT DOCUMENTS 609197 9/1948 United Kingdom .

OTHER PUBLICATIONS

Modern Plastics, Oct. 1948 pp. 88–91 "Plastic That Glow In the Dark".

*Primary Examiner*—Kriellion S. Morgan

*Attorney, Agent, or Firm*—Kerkam, Stowell, Kondracki & Clarke

[57] ABSTRACT

Thermoplastic polymeric material in pelletized or chip form are initially coated with a wetting agent in a mixer, then a powdered phosphorescent pigment is added to the mixer and mixing continued until the pellets are substantially uniformly coated with phosphorescent powder. The coated polymeric material is then fed to an extruder where it is heated to form a melt and mixed to distribute the phosphorous material uniformly throughout the melt before being extruded to form phosphorescent textile fibers, filaments, yarns, tapes or fibrillated films having highly uniform phosphorescent properties.

28 Claims, No Drawings

PROCESS FOR PRODUCING PHOSPHORESCENT YARN AND YARN PRODUCED BY THE PROCESS

BACKGROUND OF THE INVENTION

1. Field of the Invention

This invention relates to an improved phosphorescent textile fiber and to a process for producing such phosphorescent fiber suitable for use in the production of textile articles.

2. Description of the Prior Art

Synthetic resins or polymeric materials having phosphorescent or luminescent qualities have been used to make a wide variety of goods such as amusement devices, signs, safety devices, articles of clothing and the like. It is also known to use fluorescent dyes in the production of commercial textile articles including yarns and the like. It should be pointed out, however, that the arts of producing phosphorescent and fluorescent materials are quite different in many instances. For example, many fluorescent dyes of are relatively lightweight compounds whereas phosphorescent materials such as zinc sulfide may be relatively heavy in comparison with the synthetic resin materials to be treated.

U.S. Pat. No. 2,382,355 to Warren discloses a luminous rope in which the filaments are formed from a resinous material having a suitable luminous material molded within the filaments. According to the patent, the phosphorescent (or fluorescent) material is mixed in the plastic while in the powdery form or at any point in the rope making process prior to the extrusion or cold rolling of the plastic into filaments so that the luminous material is dispersed throughout the mass of plastic. In other embodiments, the luminous material is mixed in a plastic carrier and coated on the filaments, then covered with a transparent or translucent plastic coating. The individual filaments are formed by stretching or drawing through a die to orient the molecules in the strand for tensile strength.

U.S. Pat. No. 2,436,182 to Schmidling discloses a molded phosphorescent device formed from a resin material having a phosphorescent filler blended throughout the resin. Various articles are made from the relatively heavy rigid molded mass.

U.S. Pat. No. 2,838,762 to Wadely discloses a floor covering or rug having designs therein formed from yarns which are impregnated with a phosphorescent material. The phosphorescent yarns are coated with a binder which permits the transmission of light therethrough.

U.S. Pat. No. 4,640,797 to Goguen discloses a process for preparing a phosphorescent polymeric material for use in the molding of shoes for runners, cyclists, or the like, and in which the elastomeric material and from 20 to 50% by weight of processing oil is heated and blended in an extrusion apparatus and then from 3 to 30% by weight of a phosphorescent material (with other ingredients) is blended with the melting ingredients as thoroughly as possible before the finished product is formed into pellets or the like for subsequent use in molding the shoe soles. The oil used is as a plasticizer for the polymeric material.

U.S. Pat. No. 4,781,647 to Doane teaches a process for extruding a thermoplastic polymer containing a mixture of phosphorescent particles. The extrusions are of a dimension to be suitable for use to make doll hair which glows in the dark. The phosphorescent material is stated to have a maximum particle size which is less than one half the diameter of the strands. The strands have a diameter of less than 0.015 inches and preferably in the range of 0.002 to 0.004 inches, and preferably the polymeric material consists of polyamides, polyesters, polyolefins, polyacrylonitriles and polyvinyl chlorides. The phosphorescent material may be zinc sulfide, cadmium sulfide or calcium sulfide. A coupling agent is used to coat the phosphorescent particles to enhance mixing.

U.S. Pat. No. 5,135,591 to Vockel et al discloses a process for making phosphorescent fiber reinforced plastic articles in which the a phosphorescent material is encapsulated on a surface of the molded finished product.

While it is apparent from the above and other prior art patents that extensive efforts have been made to utilize the phosphorescent properties of materials such as zinc sulfide, substantial difficulty has been encountered in producing satisfactory products. For example, it is not heretofore been considered practical to form a phosphorescent fiber suitable for use in yarn such as bulked continuous filament (BCF) yarn of thermoplastic polymers such as polypropylene, nylon, and polyester having properties suitable for commercial use in the textile industry. For such use, it is obvious that the yarn must possess and retain a high degree of uniformity in the phosphorescent properties as well as color and the like, and that the phosphorescent materials used not adversely affect processing characteristics, including dyeing or physical properties of the yarn or filaments formed.

While it cannot be determined for certain, it is believed that a primary problem in producing synthetic yarns having phosphorescent particles therein has been the inability to adequately mix the phosphorescent material with the synthetic resin material. The relatively heavy nature of the most widely used commercial phosphorescent material, when compared with the weight of the polymers used, tends to cause the phosphorescent material to settle. Further, in the past the dry phosphorescent material has generally been added in the melt extruder where the auger was relied upon to physically agitate and mix the materials. It is apparent, however, that for forming of very fine fibers or filaments, only slight variations in the concentration of solid particles can result in inferior product or even interruption of the process.

In the production of BCF yarn of thermoplastic polymers in a commercial melt spinning line, pigment or other foreign matter loading above about 1% for solution dyed yarns are generally considered unusual and loadings of 2 to 3% have been considered to be the upper limit for such commercial manufacturing process.

It is an object of the present invention to provide an improved method of producing continuous phosphorescent filaments or fibers suitable for use in the textile industry.

It is another object of the present invention to provide an improved method of melt spinning phosphorescent yarns or filaments from a thermoplastic polymer material.

Another object is to provide such a method which enables loading of the polymer material with a relatively high percentage of finely divided phosphorescent pigment to produce a high degree of phosphorescence.

Another object is to provide an improved monofilament, spun, continuous filament and/or BCF phosphorescent yarn which has a substantially uniform phosphorescent property.

Another object is to provide an improved textile fiber or filament produced by such a process.

SUMMARY OF THE INVENTION

In the attainment of the foregoing and other objects and advantages, an important feature of the invention resides in mixing phosphorescent material in a finely divided form with a thermoplastic polymer in a manner which achieves substantially uniform distribution of the particles of phosphorescent powder throughout the polymer before spinning. This is achieved by utilizing a suitable wetting agent to coat each pellet of the polymer to be used, then adding the finely divided phosphorescent powder and tumbling or otherwise mixing so that the powdered pigment is substantially uniformly adhered to the external surface of all pellets. The pellets, coated with the wetting agent and phosphorescent powder pigment can then be fed to a commercial extrusion apparatus where the pellets are heated and mixed before being extruded to form the filaments. By having the powdered phosphorescent pigment uniformly adhered to the surface of each pellet, a highly uniform distribution of phosphorescent material throughout the melt is achieved, enabling operation of commercial melt spinning apparatus with a high loading of phosphorescent material to produce a highly uniform product having characteristics suitable for use in the textile industry to produce a high grade commercial phosphorescent textile product.

DETAILED DESCRIPTION OF THE INVENTION

In accordance with the present invention, phosphorescent fibers, filaments, yarns, tapes or fibrillated (split) films or tapes are formed from a thermoplastic polymeric material. Finely divided phosphorescent pigment is dispersed substantially uniformly throughout a melt of the polymeric material and formed, as by extrusion, in a melt spinning apparatus to produce a fiber, filament yarn or the like which exhibits the desired phosphorescence and which contains physical properties suitable for use in the textile industry. The phosphorescent material may be a commercially available activated zinc sulfide in finely divided or powdered form preferably having a mean particle size no greater than about 30 microns. The polymer used may be any suitable thermoplastic polymer capable of processing in a commercial extrusion operation such as nylon, polypropylene or polyester, which are widely used in the production of BCF yarns used by the textile industry.

Although the process may be used to produce fiber in various forms including monofilaments, multifilament, staple yarns, tape or fibrillated film, the process is particularly suited for the production of BCF yarn, and will be described with reference to the production of such yarn, it being understood that the invention is not so limited.

Chipped or pelletized polymeric material, along with and any necessary or desired stabilizers or the like, is prepared in a mixer or tumbler and a wetting agent such as a suitable oil compatible with the polymer is sprayed onto the pellets. The material is then tumbled or mixed until each pellet is wet over its entire outer surface. The desired amount of powdered phosphorescent material is then added and tumbling is continued until the powdered pigment adheres uniformly to each pellet in the mixer. The material is then fed to an extruder where it is processed in the conventional manner to melt the polymer and to thoroughly mix the phosphorescent material throughout the melt.

As indicated above, coating the pellets with the wetting agent results in the powdered phosphorescent material adhering to each pellet in a substantially uniform coating regardless of the amount of powder added. This uniform distribution of the phosphorous powder throughout the extruder charge effectively eliminates concentrations of solid particles which can adversely affect physical properties of the individual filaments or produce non-uniformity in the phosphorescent properties of a finished product produced from the yarn.

The uniform distribution of the fine phosphorescent particles does not adversely affect dyeing. Thus, yarn produced by the process may have a color imparted thereto by solution dyeing or by a secondary dyeing process such as beck dyeing, package dyeing, piece dyeing, continuous dyeing, space dyeing or printing to yield either solid or multi-colored yarns in accordance with standard dyeing procedures. The individual fibers or filaments may be either solid or hollow and have any conventional shape such as round, triangular, rectangular, trilobal, square, hexagonal, pentagonal or the like. Multi-filament yarn spun from the product may be air entangled, twisted and heat set, or braided, or treated in any manner conventional with multifilament or spun polymeric yarns. The yarns may be used to produce fabric in which the yarn is tufted, overtufted, woven, knitted, braided, fusion bonded, flocked, felted, fused, sewn or treated in any conventional manner. Such fabric may be printed with patterns to selectively cover or expose the phosphorescent fibers.

Examples of applications for the product of this invention include carpets, rugs, mats, upholstery fabric, wall coverings, apparel, heavy industrial fabrics, rope and cordage, shoe laces, safety products, netting and the like.

The following examples show by way of illustration and not by way of limitations preferred embodiments of the invention:

EXAMPLE 1

Bulked continuous filament yarns of polypropylene having phosphorescent properties were produced on a commercial production line at a carpet mill using a production compact melt spinning line capable of extruding both polypropylene and nylon BCF yarns. The pelletized polypropylene material to be used was placed in a tumbling mixer and sprayed with approximately 0.1% by weight of mineral oil as a wetting agent and tumbling was continued until each pellet was coated. A commercial activated zinc sulfide phosphorescent pigment in finely divided or powdered form with the particles having a mean size of about 30 microns was added in the tumbler and tumbling was continued until all powdered pigment was adhered to the surface of the pellets and a visual inspection indicated that each pellet was substantially uniformly coated.

The melt spinning line was started using untreated or natural polypropylene pellets and run until the spinning process stabilized, at which point the extruder feed was switched to the coated pellets. Minor adjustments to the line were required and the process soon stabilized. Runs were made using 78 hole and 120 hole spinnerettes.

Beginning with 1% by weight of phosphorescent material, yarns were produced and examined. At 1% loading, the yarn had good physical characteristics but did not exhibit the desired degree of phosphorescence and the phosphorescent pigment concentration was increased to 2%, 2½%, and 3%. Phosphorescence of the 2% product was marginal but the 2.5% and 3.0% product exhibited very good phosphorescence. As the content of phosphorescent material increased, processing problems initially developed but the equipment was adjusted in accordance with line practice and further performance was very successful both from the processing and product standpoint.

Yarn produced from the 2.5% and 3% phosphorescent pigment contained the following physical properties:

| | |
|---|---|
| Denier | 2233 |
| Breaking strength | 3500 to 3700 grams |
| Tenacity | 1.59 grams per denier |
| Elongation | 36.7% |
| Natural crimp | 2.83% |
| Annealed crimp | 8.74% |
| Shrinkage | 2.03% |

The physical properties of the yarn were consistent and typical of most polypropylene BCF yarns. The phosphorescent pigment survived the melt spinning temperature of 490° F. without evidence of deterioration and overall processing was good.

EXAMPLE 2

Using the same equipment described above, a run was made to confirm the ability to extrude nylon BCF yarn having phosphorescent properties. Spinnerettes having 78 and 120 holes were used. Since nylon is generally considered more reactive than polypropylene, known stabilizers were also added to the polymer. The nylon chips and pelletized stabilizer additives were mixed and mineral oil was added as a wetting agent to completely wet the surface of the polymer and stabilizer pellets during the tumbling and mixing operation. Phosphorescent pigment was then added as described above.

Because of the known hygroscopic nature of the nylon pellets, the quantity of wetting agent used was increased to 0.63%, by weight, for the first run. Use of increased amounts of the wetting agent appeared to retard moisture absorption by the nylon chips and result in improved viscosity and processability of the heavily loaded compound.

To start the test the apparatus was initially run using only nylon pellets. When the unit stabilized, the system was switched to the wetted pellets and stabilizer and, after again stabilizing, a blend containing 3% by weight of phosphorescent pigment was used. This pigment loading was increased to 4%, 5%, 7% and 10% in subsequent runs. At the 10% loading, minor adjustments to the process were required but overall processing characteristics were good for all loadings. Thereafter, a loading of 15% by weight of phosphorescent pigment was attempted. Filament breaks were encountered at this loading and the trial was ended after obtaining samples of the product with 15% phosphorescent material. While it is believed that further adjustment to the process would have resulted in successful running of nylon containing 15% by weight of phosphorescent material, this level of loading appeared to be approaching the practical upper limit for a high speed commercial operation. Samples of yarn produced during this run had the characteristics presented in the table below, with all figures shown being the result of an average of three samples which were all surprisingly consistent.

| | Nylon BCF Yarn Physical Properties Percent Phosphorescent Pigment | | | | | |
|---|---|---|---|---|---|---|
| | 3.0% | 4.0% | 5.0% | 7.0% | 10.0% | 15.0% |
| Denier | 2790 | 2747 | 2806 | 2763 | 2851 | 2775 |
| Break (Gms) Strength | 4867 | 5000 | 4450 | 4283 | 3733 | 3617 |
| Tenacity | 1.74 | 1.82 | 1.58 | 1.55 | 1.31 | 1.30 |
| Elongation | 26.4 | 28.8 | 25.0 | 23.9 | 23.9 | 24.3 |
| Natural Crimp | 4.04 | 4.68 | 4.45 | 3.57 | 3.01 | 2.64 |
| Annealed Crimp | 3.80 | 4.69 | 4.48 | 3.73 | 3.23 | 3.28 |
| Shrinkage | 6.93 | 6.33 | 5.59 | 6.47 | 6.60 | 6.56 |

EXAMPLE 3

Using the same equipment described in the two previous examples, a trial was made for the purpose of increasing the loading of phosphorescent pigment in polypropylene and to reduce filament denier to a size suitable for further processing on conventional staple spinning machines. Generally, the filament denier of an extruded staple fiber must be below 25 in order to be spun on such machines. Both trilobal and delta (triangular) fiber cross sections were run using 78 and 120 hole spinnerettes.

Preparation of the polypropylene pellets was performed as before except that the application of wetting agent was increased to approximately 0.2% by weight. The line was first stabilized on natural resin and then stabilized once again on resin pellets coated with wetting agent. During the initial run, phosphorescent pigment was added to the wetted pellets at a level of 3.0%. The loading was then increased to 4.0%, 5.0% and finally to 7.0%. Processing adjustments were made as the concentration of pigment was increased to 5.0%. Excellent results were obtained at the 5.0% concentration.

At a loading of 7.0%, the processability of the compound deteriorated and the trial was ended after samples were obtained. It is thought that dispersing aids will be required for polypropylene fibers above to 5.0% concentration to improve processability.

Yarn physical properties obtained from representative samples of this trial were quite favorable. Although a lower filament denier was run and the loading of phosphorescent pigment was increased over the previous trial (Example 1), physical properties were comparable to those previously obtained at a 3.0% concentration:

| | 5.0% Loading | 7.0% Loading |
|---|---|---|
| Denier | 2022 | 2042 |
| Breaking Strength | 3162 grams | 2987 grams |
| Tenacity | 1.56 GMS/denier | 1.46 GMS/denier |
| Elongation | 25.5% | 25.2% |
| Natural Crimp | 3.71% | 3.81% |
| Annealed Crimp | 8.93% | 8.27% |
| Shrinkage | 1.53% | 1.80% |

The values obtained were consistent with variance levels over the four specimens tested in each type determined to be well within normal operating specifications. The processing results and physical properties achieved in this trial were considered to be significantly improved over the previous trial (Example 1).

A filament denier of 17 was achieved in this trial, confirming that a phosphorescent fiber of this invention can be extruded into a filament denier suitable for further processing into staple yarns on conventional staple spinning machines. It also demonstrated that the invention is suitable for the manufacture of continuous melt formed nonwoven fabrics.

Specimens of nylon and polypropylene phosphorescent yarns produced in Example 3 were evaluated for secondary processing characteristics on machinery for producing twisted and heat set yarns and finished fabrics. Processing trials on twisting, heat setting, tufting and finishing machines was judged to be typical for those of comparable non-phosphorescent solution dyed yarns. No significant adverse characteristics were found.

Performance tests have also been made on yarns, and on fabrics produced from the yarns of the present invention by an accredited independent testing laboratory to determine the lightfastness, accelerated weathering, flammability, abrasion resistance, simulated wear testing, electrostatic properties, chemical resistance and retention of phosphorescence properties. To date, all test results have been favorable. The performance of both nylon and polypropylene BCF yarns produced in the aforementioned examples has indicated that their performance characteristics are typical of comparable solution dyed yarns containing significantly lower concentrations of non-phosphorescent pigments. No significant reduction in textile fiber or fabric performance has been found which can be attributed to the extremely high concentrations of phosphorescent pigment contained in yarns of this invention.

While the foregoing examples illustrate preferred embodiments of the invention, it is to be expressly understood that the invention is not limited thereto nor is it limited to the particular materials recited in the examples. For example, other thermoplastic materials such as polyesters (PET and PBT) conventionally used in the production of filament yarns and staple yarns employed in the textile industry may be used. Various wetting agents may also be used so long as they are compatible with the polymer being used. Further, known stabilizing agents may be employed, for example, to reduce oxidation and thermal, chemical and ultraviolet degradation or the like, as is known in the industry.

It should be pointed out that the weight of the yarn shown in Examples 1, 2 and 3 above is expressed in terms of the denier of the complete yarn while runs were made with extrusion heads having both 78 and 120 openings. A more meaningful indicator of the size of filaments extruded might be expressed in terms of denier per filament and in this regard, experience obtained from runs made to date indicate that the filament denier achievable for both nylon and polypropylene should be within the range of about 5 to 100 while the preferred denier per filament would be in the range of about 10 to about 60.

While a preferred embodiment of the invention has been disclosed and described, it should be apparent that the invention is not so limited and it is therefore intended to include all embodiments which would be apparent to one skilled in the art and which come within the spirit and scope of the invention.

What is claimed:

1. In a melt spin process for forming synthetic textile fiber filaments from a thermoplastic polymer in which the polymer in pellet form is fed into an extruder where it is heated and mixed to form a melt and the melt is extruded to form the filaments or fibers, the improvement comprising, initially combining predetermined amounts of polymer pellets and a wetting agent in a mixer and mixing to substantially uniformly wet the surface of the solid pellets, adding solid phosphorescent pigment in powdered form in an amount of from about 2% to about 15% by weight in the mixer and continuing to mix until the polymer pellets are substantially uniformly covered with pigment, and mixing and heating the pigment coated polymer in an extruder to form and extrude the melt whereby a highly uniform distribution of phosphorescent pigment is obtained throughout the filaments.

2. The process defined in claim 1 wherein said phosphorescent pigment comprises zinc sulfide.

3. The process defined in claim 2 wherein said polymer is selected from the group comprising polypropylene, nylon and polyesters.

4. The process defined in claim 1 wherein said polymer is nylon and wherein the step of adding solid phosphorescent pigment comprises adding from about 3% to about 12%, by weight of zinc sulfide to the polymer.

5. The process defined in claim 4 wherein the step of adding said wetting agent comprises adding from about 0.3% to about 5% of an oil compatible with nylon as the wetting agent.

6. The process defined in claim 5 wherein said wetting agent is mineral oil.

7. The process defined in claim 6 wherein the mean particle size of said zinc sulphide is no greater than about 30 microns.

8. The process defined in claim 1 wherein said polymer is polypropylene and wherein the step of adding phosphorescent pigment comprises adding from about 2% to about 5% by weight of zinc sulfide to the polymer.

9. The process defined in claim 8 wherein the step of adding said wetting agent comprises adding from about 0.1% to about 3% by weight of an oil compatible with the polypropylene.

10. The process defined in claim 9 wherein said wetting agent is mineral oil.

11. The process defined in claim 10 wherein the mean particle size of said zinc sulphide is no greater than about 30 microns.

12. The process defined in claim 1 wherein the step of extruding the melt comprises simultaneously melt spinning a plurality of filament to form a spun yarn.

13. The process defined in claim 12 wherein said yarn is a bulked continuous filament yarn.

14. Phosphorescent synthetic textile filaments formed by the process defined in claim 1, said filaments having a denier within the range of about 5 to about 100.

15. The phosphorescent synthetic textile filaments defined in claim 14 wherein the thermoplastic polymer is polypropylene and wherein said textile filaments contain from about 2% to about 7% by weight of phosphorescent material and wherein the filaments have a denier within the range of about 10 to about 60.

16. The phosphorescent synthetic textile filaments defined in claim 15 wherein said phosphorescent material is present in the amount of from about 3% to about 5%, by weight and wherein the mean particle size of the phosphorescent material is no greater than about 30 microns.

17. The phosphorescent synthetic textile filaments defined in claim 14 wherein said thermoplastic polymer is nylon and wherein said phosphorescent material has a mean particle size no greater than about 30 microns.

18. The phosphorescent synthetic textile filaments defined in claim 17 wherein said phosphorescent material is present in an amount of from about 3% to about 10%.

19. The phosphorescent spun polymeric textile filaments defined in claim 18 wherein said filaments have a denier within the range of about 10 to about 60.

20. Phosphorescent synthetic textile yarn formed by the process defined in claim 12, the filaments of said yarn having a denier within the range of about 5 to about 100.

21. The phosphorescent synthetic textile yarn defined in claim 20 wherein the thermoplastic polymer is polypropylene and wherein said filaments of said yarn contain from about 2% to about 7% by weight of phosphorescent material and wherein the filaments have a denier within the range of about 10 to about 60.

22. The phosphorescent synthetic textile yarn defined in claim 21 wherein said phosphorescent material is present in an amount of from about 3% to about 5%, by weight and wherein the mean particle size of the phosphorescent material is no greater than about 30 microns.

23. The phosphorescent synthetic textile yarn defined in claim 20 wherein said thermoplastic polymer is nylon and wherein said phosphorescent material has a mean particle size no greater than about 30 microns.

24. The phosphorescent synthetic textile yarn defined in claim 23 wherein said phosphorescent material is present in an amount of from about 3% to about 10%.

25. A phosphorescent spun polymeric textile yarn containing a phosphorescent pigment in an amount of about 2% to about 15% by weight substantially uniformly dispersed throughout the yarn filaments, said yarn having a filament denier within the range of about 5 to about 100, and said phosphorescent pigment being a finely divided solid having a mean particle size no greater than about 30 microns.

26. The phosphorescent spun polymeric yarn defined in claim 25 wherein said filament denier is within the range of about 10 to about 60.

27. The phosphorescent spun polymeric yarn defined in claim 26 wherein said polymer is nylon and wherein said pigment is present in an amount of about 3% to about 12%, by weight.

28. The phosphorescent spun polymeric yarn defined in claim 26 wherein the polymer is polypropylene and wherein said phosphorescent material is present in an amount of from about 3% to about 5%, by weight.

* * * * *